United States Patent [19]

Pomey

[11] 4,139,765

[45] Feb. 13, 1979

[54] APPARATUS FOR COUNTING PRINTED PRODUCTS ARRIVING UPON A CONVEYOR PATH IN AN IMBRICATED PRODUCT STREAM AND METHOD OF OPERATING SUCH APPARATUS

[75] Inventor: René Pomey, Winterthur, Switzerland

[73] Assignee: Ferag AG, Hinwil, Switzerland

[21] Appl. No.: 834,491

[22] Filed: Sep. 19, 1977

[30] Foreign Application Priority Data

Oct. 28, 1976 [CH] Switzerland ..... 13580/76

[51] Int. Cl.[2] ..... G06M 7/00

[52] U.S. Cl. ..... 235/92 SB; 235/92 R; 235/98 B

[58] Field of Search ..... 235/92 PK, 92 SB, 98 R, 235/98 B; 198/DIG. 11, 40; 93/93 C

[56] References Cited

U.S. PATENT DOCUMENTS

| | | | |
|---|---|---|---|
| 2,208,270 | 7/1940 | Grout | 235/92 SB |
| 2,580,192 | 12/1951 | Potter | 235/92 SB |
| 3,024,985 | 3/1962 | Heil | 235/92 SB |
| 3,239,138 | 3/1966 | Loeffler | 235/98 R |
| 3,571,574 | 3/1971 | Gerber | 235/92 SB |
| 3,577,955 | 5/1971 | Palmer | 235/98 B |
| 3,702,925 | 11/1972 | Anderson et al. | 235/92 SB |
| 3,737,666 | 6/1973 | Dutro | 235/92 PK |
| 3,813,522 | 5/1974 | McCarthy | 235/98 R |
| 3,862,402 | 1/1975 | Igarashi et al. | 235/92 SB |

*Primary Examiner*—Joseph M. Thesz
*Attorney, Agent, or Firm*—Werner W. Kleeman

[57] ABSTRACT

An apparatus for counting printed products arriving at a conveyor path or track in an imbricated product stream, comprising a feeler bearing under the action of a contact force upon the product stream and secured against entrainment in the conveying direction of the product stream; this feeler cooperating with an electrical signal transmitter. The feeler comprises an overhang arm of a sound pick-up like transducer cell mounted in a support. The support possesses a support element which serves to bear upon the imbricated product stream. The free end of the overhang arm is structured such that it scans or feels the surface of the imbricated product stream at the region of bearing contact of the support element.

The method of operating such apparatus for counting folded printed products is manifested by the features that the overhang arm of the transducer cell is directed to that side of the imbricated product stream at which there is accessible the edges of the printed products located opposite the fold.

10 Claims, 7 Drawing Figures

Fig. 1
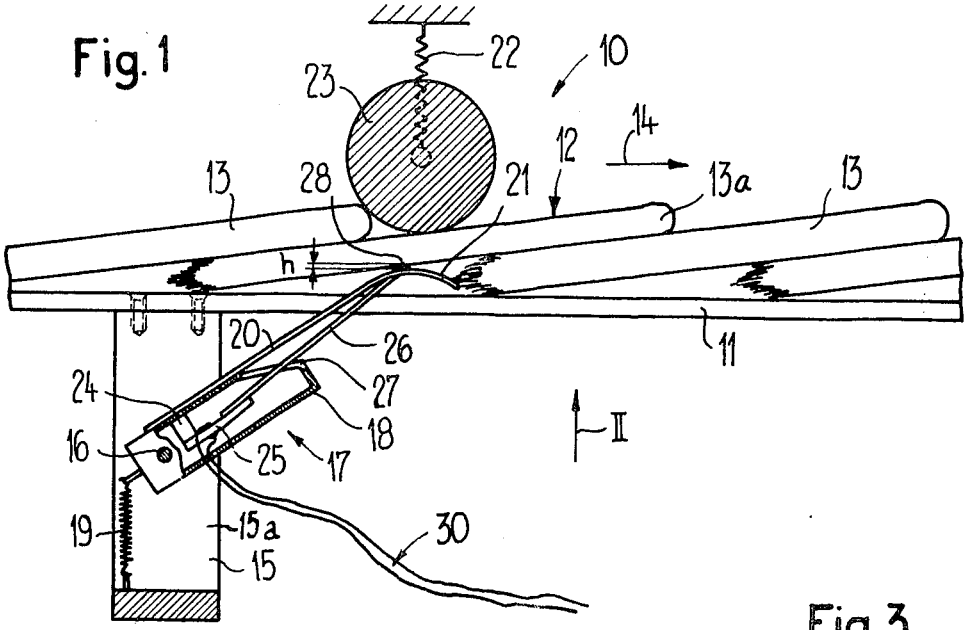
Fig. 3
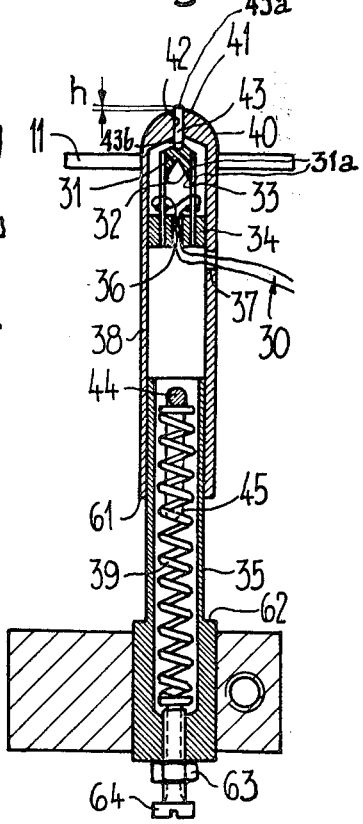
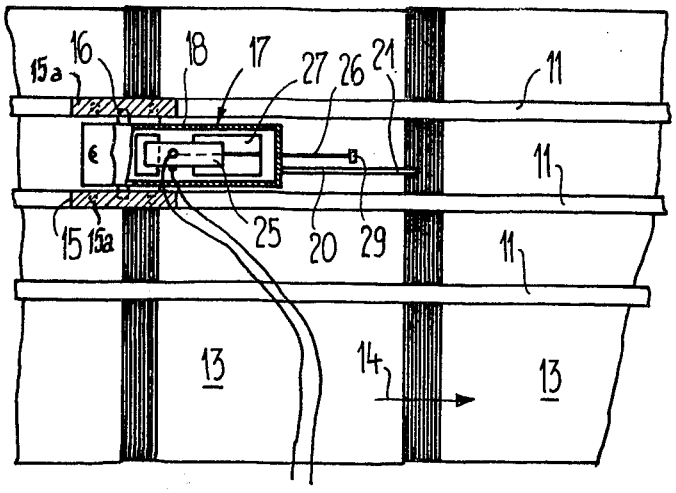
Fig. 2

Fig. 4
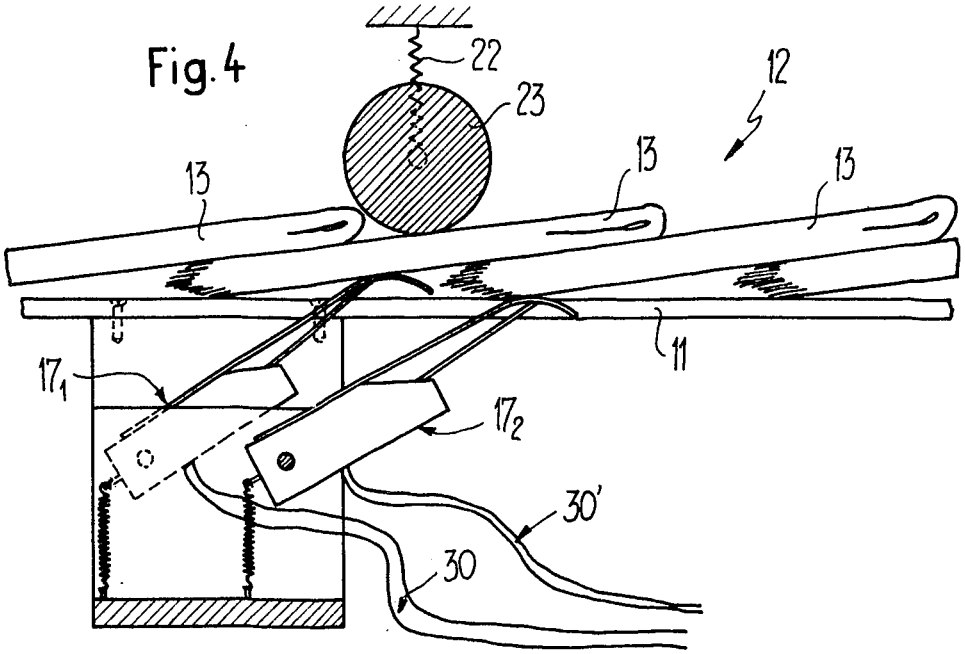
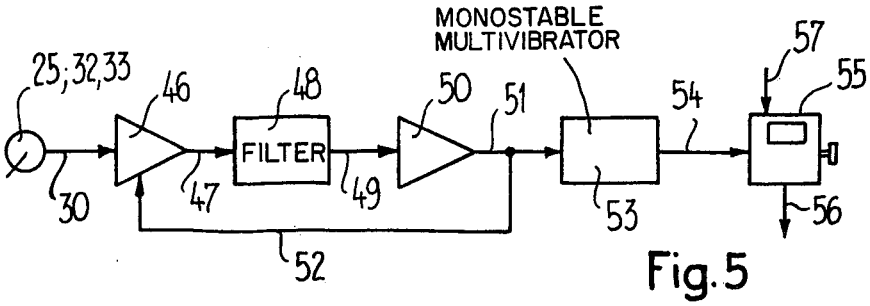
Fig. 5
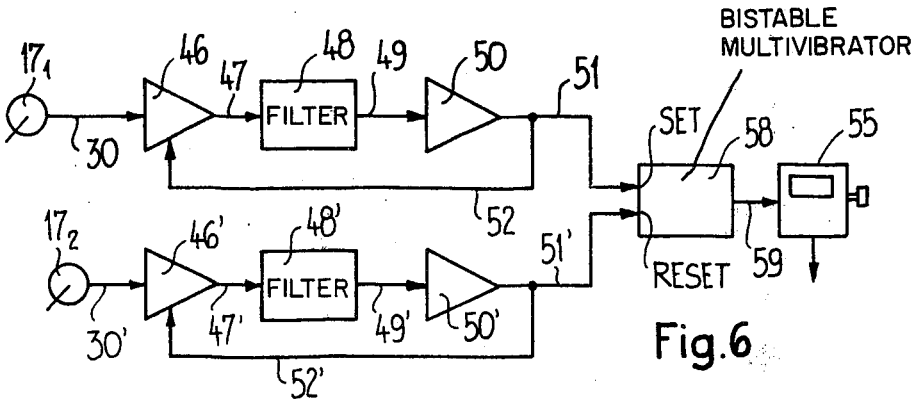
Fig. 6

APPARATUS FOR COUNTING PRINTED PRODUCTS ARRIVING UPON A CONVEYOR PATH IN AN IMBRICATED PRODUCT STREAM AND METHOD OF OPERATING SUCH APPARATUS

BACKGROUND OF THE INVENTION

The present invention relates to a new and improved construction of apparatus for counting printed products arriving upon a conveyor path or track in an imbricated product stream, which apparatus is of the type comprising a feeler which bears under the action of a contact force upon the imbricated product stream and is secured against entrainment in the conveying direction of the product stream, this feeler cooperating with an electrical signal transmitter. The invention also is directed to a method of operating the apparatus for counting such printed products.

According to a state-of-the-art apparatus of this type, as disclosed for instance in Swiss Pat. No. 382,477, the feeler is coupled with a tab, and during throughpassage of a printed product the feeler and thus the tab are deflected, so that a light barrier is interrupted which, in turn, delivers the signal required for counting purposes. This construction is useful as long as the thickness of the printed products which are to be counted does not fall below a minumum value, and furthermore, is maintained only within relatively narrow limits. Additionally, the counting speed of the prior art apparatus is no longer capable of coping in all instances with the production capacity of modern high speed rotary printing presses. This should be readily evident if it is realized that the tab which interrupts the light barrier in the case of a deflection brought about only by the thickness of one or two sheets of paper is not capable of positively interrupting the light barrier and, moreover, the tab, following each interruption of the light barrier, must again free such light barrier. Furthermore, in the case of very thick product copies there must be resorted to special measures in order to limit the deflection of the tab or the like.

SUMMARY OF THE INVENTION

Hence, it is a primary object of the present invention to provide a new and improved construction of apparatus of the previously mentioned type which is capable of faultlessly counting printed products throughout practically all thicknesses which are encountered, i.e., from the size of individual sheets up to over 100 sheets of thick printed products, without having to undertake structural modification work due to the thickness of the incoming or arriving printed products.

Yet a further significant object of the present invention aims at a new and improved method of operating an apparatus of the type taught by the invention.

Yet a further object of this invention aims at the provision of a new and improved construction of apparatus for counting printed products and the like arriving in an imbricated product stream upon a conveyor path or track, in a highly efficient, reliable and economical manner, generally independent of the thickness of the printed products normally encountered in practice.

Now in order to implement these and still further objects of the invention, which will become more readily apparent as the description proceeds, the apparatus proposed by the present invention is manifested by the features that the feeler comprises an overhang arm of a sound pick-up like transducer cell mounted in a holder or support, this holder possessing a support element which is supported upon the imbricated product stream. The free end of the overhang arm is constructed such that it feels the surface of the imbricated product stream at the region of contact of the support element.

The method for operating such type apparatus, especially for counting folded printed products, contemplates aligning the overhang arm of the transducer cell at that side of the imbricated product stream at which there are accessible the edges of the printed products which are located opposite the fold.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a schematic sectional view of a first embodiment of the invention;

FIG. 2 is a view, partially in section, looking in the direction of the arrow II of FIG. 1;

FIG. 3 is a sectional view of a modified construction;

FIG. 4 illustrates an arrangement embodying two successively dispositioned signal transmitters;

FIG. 5 is a block diagram of an electrical circuit suitable for the embodiments of FIGS. 1, 2 and 3;

FIG. 6 is a block circuit diagram of an electrical circuit suitable for the arrangement of FIG. 4.

DETAILED DESCRIPTION OF THE PREFERRED EMBODIMENTS

Figure 7:
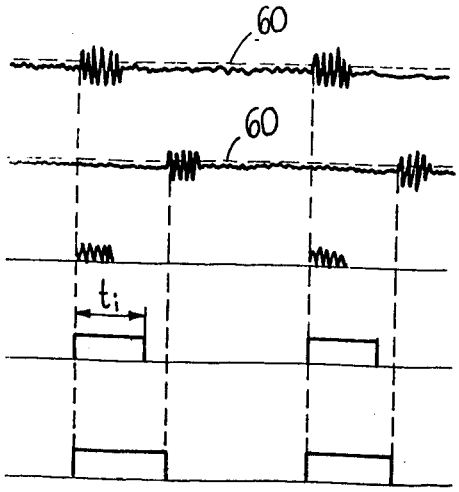
FIG. 7 illustrates electrical signals which are formed during operation of the circuitry of FIGS. 5 and 6.

Describing now the drawings, with the apparatus 10 illustrated by way of example in FIGS. 1 and 2, there will be recognized a conveyor path or track formed by guide rails 11 or equivalent structure. Upon such conveyor track there is fed an imbricated product stream 12 of, for instance, folded printed products 13 — here assumed to be newspapers — with the edge 13*a* leading, the products being conveyed in the direction of the arrow 14. The drive means, which moves the imbricated product stream 12 in the direction of the arrow 14, can be of any suitable construction, for instance, a small band conveyor, the small bands or belts of which are arranged between the rails 11, or a suitable transport device engaging with the lateral edges of the imbricated product stream 12. Since the conveyor means, whether such incorporate bands or a transport device, constitutes conventional structure and does not pertain to underlying concepts or aspects of the invention, the same has not been further illustrated and need not be additionally considered at this point in the disclosure.

At the side facing away from the imbricated product stream 12 there are fixedly threaded to two neighboring rails 11 the ends of the legs of a substantially U-shaped support or carrying bracket 15. At a pivot pin 16 which bridges the intermediate space between the legs, generally designated by reference character 15*a*, of the support or carrying bracket 15 and anchored therein, there is pivotably mounted a transmitter designated in its entirety by reference character 17. Transmitter 17 possesses a housing 18 at which engages one end of a tension spring 19 anchored at the support bracket 15, this tension spring 19 striving to rock the housing 18 and therewith the entire transmitter 17 in the counterclockwise direction of the showing of FIG. 1. Furthermore, a runner 20 is attached in any convenient fashion to the housing 18 and protrudes therefrom, as best seen by referring to FIG. 1. This runner 20 possesses a free end 21 which is flexed or bent in the manner of a ski. It will be further understood that the runner 20 of the housing 18 which bears at the underside of the imbricated product stream 12 which is pressed against the guide rails 11 by the action of a contact or pressure roller or roll 23 loaded by a spring 22, and equally the transmitter 17, carry out tilting movements as a function of the throughpassing printed products 13, the amplitude of which movements is dependent upon the thickness of the printed products 13.

It is not the tilting or pitching movements which are used for generating the signals. For this purpose there is attached internally of the housing 18 upon a block 24 a transducer cell 25 — in this case of piezoelectric transducer — at which there is attached an overhang arm 26, as in the manner of a conventional sound pick-up. The overhang arm or cantilever 26 extends through an opening 27 formed in the housing 18 and in a direction approximately parallel to the runner 20. The free end 28 of the overhang arm 26 protrudes by a small amount h on the order of magnitude of up to about 1 mm, past the end 21 of the runner 20 which forms the support surface of the transmitter 17 and in the direction of the imbricated product stream 12, as long as such end 21 does not directly bear upon the scanned surface of such product stream 12. On the other hand, during contact therewith the free end 28 of the overhang arm 26 is disposed practically in the same plane as the point of contact of the end 21 of the runner 20 at the imbricated product stream 12.

As best seen by referring to FIG. 2, a small sliding plate 29, formed of a wear-resistant material, can be attached to the free end 28 of the overhang arm or cantilever 26. It will be understood that the aforementioned pitching or tilting movements of the transmitter 17 do not yet produce any signal in the transducer 25. The end of the overhang arm 26 on the other hand detects — similar to a sound pick-up — the finest irregularities, including the roughness of the paper, and delivers a continuous signal, the form of which is approximately an image of the fine structure of the scanned surface.

It should be understood that the transducer cell 25 need not necessarily be constituted by a piezoelectric transducer. It is left to those skilled in the art to employ other suitable transducers, where appropriate, for instance an inductive, a capacitive or another mechanical-electrical transducer cell, provided that they directly deliver a processable electrical signal in response to the slightest deflection or movement of the overhang arm 26.

The signal generated by the transducer cell 25 is delivered by a line or conductor 30, preferably by means of a shielded cable, to a circuit which is still to be described hereinafter.

With the embodiment illustrated in FIG. 3 there is provided as a stationary element a guide tube 35 upon which there is displaceably mounted a sleeve or sleeve member 38 constructed as a housing. This sleeve member 38 is exposed to the action of a pressure or compression spring 39 which strives to displace the sleeve 38 with its rounded end 40 protruding from the guide tube 35 away therefrom and from below past the guide rails 11 and to press such sleeve against the imbricated product stream which has not been particularly shown in FIG. 3. The apex 41 of the rounded end 40 of the sleeve 38 is constructed as a support surface and possesses a continuous bore 42. Extending through the bore 42 is a feeler pin 43 which is displaceable within such bore, the outer end 43*a* of the feeler pin 43 protruding past the apex 41 by the dimension h, as long as the feeler pin 43 does not bear upon a surface. The inner end 43*b* of the feeler pin 43 is anchored at the central region of a spreadable or expandable bracket 31 formed of an elastically flexible material, for instance of rubber. Both of the free ends 31*a* of the spreadable or expandable bracket 31 are each secured to a not particularly referenced free end of a piezoelectric transducer element 32, 33, the other ends of which are fixedly anchored in a plug 34 secured in the sleeve 38, for instance the plug 34 being pressed into such sleeve 38. Leading from each of the transducer elements 32, 33 is a branch of the line 30 extending through a bore 36 in the plug 34 and a bore 37 in the wall of the sleeve 38, this line leading to circuitry which is still to be described.

A pin 44 extending transversely through the sleeve 38 and secured thereto, extends through a slot 45 formed in the wall of the guide tube 35 and which slot extends in the axial direction. By means of the slot 45 and the pin 44 there is thus limited the axial freedom of movement of the sleeve 38 upon the guide tube 35 at least in the one direction. In the other direction the open end face or side 61 of the sleeve 38 can cooperate with a shoulder 62 formed at the guide tube 35 and serving as a stop. The pre-bias of the compression or pressure spring 39 can be adjusted by means of an adjustment or setting screw 64 which can be blocked by a nut 63 or equivalent structure.

Just as was the case for the exemplary embodiment of FIG. 1, here the sleeve 38 carries out up and down movements as a function of the course irregularities, which movements however do not produce a signal. On the other hand, the fine irregularities, which are not detected by the sleeve 38, or not in a discernable manner, are detected by the feeler pin 43 and transmitted by means of the expandable or spreadable bracket 31 in such a sense to the transducer elements 32, 33 that such are spread apart from one another, i.e. bent-through, which in turn causes the generation of an evaluatable electrical signal at the line 30. The air pillow or cushion enclosed by the sleeve 38 opposes the up-and-down movements of the sleeve 38 to a certain extent in the form of a damping element, and thereby prevents that such up-and-down movements will produce low-frequency resonance movements which could lift the apex 41 of the sleeve 38 from time to time away from the imbricated product stream 12.

The variant embodiment of FIG. 4 practically constitutes a doubling of the construction of FIG. 1. Here there are provided two transmitters $17_1$ and $17_2$ arranged in spaced relationship from one another, which spacing is smaller than the smallest practically encountered spacing of two successive printed products 13 in the imbricated product stream 12. The reason there are provided two transmitters in the arrangement of FIG. 4 will be apparent from the discussion of the circuitry of FIG. 6 to be presented hereinafter. It should be understood that it would be also possible to employ in the arrangement of FIG. 4 two transmitters of the type shown in FIG. 3.

Now in FIGS. 5 and 6 there are shown block diagrams of circuits which, for instance, can be connected with the apparatus of FIGS. 1–3 and FIG. 4, respectively. There will be recognized in the showing of FIG. 5, the transducer cell 25 and the transducer elements 32, 33 which are connected via the line 30 at a pre-amplifier 46 possessing variable gain. The output line 47 of the pre-amplifier 46 is connected with a threshold value filter 48 (which can be combined with a low-pass filter). The filter 48 only passes signals, the amplitude of which exceeds an adjustable threshold or limit value. By means of its output line 49, the filter 48 is connected with a further amplifier 50, the output line 51 of which is connected via a feedback line 52 with the pre-amplifier 46, in order to be able to regulate the gain or amplification factor, and on the other hand is connected with a monostable multivibrator 53. This monostable multivibrator 53 possesses a return time or flop-over time $t_i$ which in any case is smaller than the throughpass time of two printed products 13 at the smallest practical spacing from one another. The filter 48 filters that part of the signal which is made available by the transducer cell 25 and the transducer elements 32, 33 respectively, which signal emanates from the surface roughness of the wiped paper surface and only allows that part of the signal through which is caused by the jumps which are carried out by the tip of the overhang arm 26 and the feeler pin 43 during jumping from one paper layer to the other. These signals are in any event of greater amplitude. Hence, at the output 51 there appears, during each throughpass of a printed product 13, a signal which while random or undetermined with regard to frequency and number of periods is well defined as concerns amplitude (owing to the variable gain of the pre-amplifier 46), and this signal triggers the monostable multivibrator 53. Such now digitalizes each of the prevailing signals to a pulse which as concerns its duration is dependent upon the flop-over or return time $t_i$, which pulse appears at the output 54 of the monostable multivibrator 53 and is further delivered to a counter 55. The counter 55 can be a display counter, a pre-selection counter, which upon reaching a pre-determined counter state or value triggers a control function by means of a line or conductor 56, or however also a counter which can be pre-programmed by means of a program line 57.

In FIG. 6 there have been designated functionally corresponding circuit components or elements as in FIG. 5, with the same reference characters, with the exception that the reference characters which belong to the circuit components associated with the subsequently arranged transmitter $17_2$ have applied thereto an apostrophe marking. Also the function of the circuit components 46, 48 and 50, as well as 46', 48', and 50' is practically the same as in FIG. 5. The difference essentially resides in the fact that the output line or conductor 51 of the amplifier 50 leads to the set-input of a bistable multivibrator 58 and the output line 51' of the amplifier 50' leads to the reset-input of the multivibrator 58. At the output 59 of the multivibrator 58 there thus appears likewise a digitalized signal, that is to say a pulse, the duration of which is not constant, rather corresponds to the travel time of a printed product from the first transmitter $17_1$ to the second transmitter $17_2$. In this way it is possible to eliminate a signal which can lead to false counting, namely when working with very thick printed products where the so-called "flower" (meaning the cut edge opposite the main fold) is not a comparatively uniform step with the paper thickness serving as the step height, or in the case of poorly (not centrally) folded printed products.

In the first two lines of FIG. 7 there is shown approximately the signal shape which is produced by the transmitters, namely in line 1 the transmitter $17_1$ and in line 2 the transmitter $17_2$. This signal shape — as long as the overhang arm or the feeler pin only slides along the paper surface — corresponds to a noise signal which approximately reproduces the roughness of the paper. This noise signal, during each throughpassage of a printed product, experiences a considerable change, since the feeler pin then carries out a jump corresponding to the paper thickness. In the first two lines of FIG. 7 there can be recognized two respective such jumps, which however are shifted in time in accordance with the offset position of the transmitters $17_1$ and $17_2$. In FIG. 7 the broken line 60 additionally indicates the threshold voltage of the filter 48 and the filter 48'. At the output line 49 of the filter 48 (and at the output 51 of the amplifier 50) there thus appears only a signal as approximately illustrated in line 3 of FIG. 7. An analogous signal, but in any case time-shifted, appears at the output line 49' and at the output line 51' of the amplifier 50' respectively. The signal of line 3 of FIG. 7 now triggers the monostable multivibrator 53 of FIG. 5, at the output of which there then appears a digital pulse-shaped signal, the duration $t_i$ of which corresponds to the return- or flop-over time of the monostable multivibrator 53 (FIG. 7, line 4).

The situation is somewhat different with the circuitry of FIG. 6. The signal which appears first in time at the output line 49 (or the line 51) triggers the bistable multivibrator 59 which then produces a signal at its output 59, until it is reset by the signal appearing at a point in time later at the line 49' (or the line 51'). In this regard, attention is directed to FIG. 7, line 5.

It should be understood that instead of the circuit elements 53, 58 there can also be employed relays. Additionally, the digitalization of the signals can also be accomplished directly after the filtering stage, where the signal which is practically continuously produced by the transducer cell 25 and the transducer elements 32, 33, is discriminated as concerns amplitude.

With the illustrated apparatus there can be obtained extremely high counter frequencies, because the moved masses are very small and because the transducer cells and the transducer elements which anyway function practically free of inertia can be designed to be of random sensitivity. Additionally, the described apparatus is non-sensitive to external light and need not be accommodated to the thickness of the incoming product copies, because it scans the imbricated product stream from the side of the conveyor path.

While there are shown and described present preferred embodiments of the invention, it is to be distinctly understood that the invention is not limited thereto, but may be otherwise variously embodied and practiced within the scope of the following claims.

Accordingly, what I claim is:

1. Apparatus for counting multisheet folded printed products conveyed in a continuous imbricated product stream in which the folded edge of each product is leading in the conveying direction and overlapping the preceding printed products and the edge opposite the folded edge is trailing comprising:

conveyor means for conveying the imbricated product stream, said conveyor means having a first side and a second side, said imbricated product stream being conveyed on said first side such that the trailing edges of the products opposite the folded edges bear against said first side;

means arranged relative to said imbricated product stream for urging the same against the first side of said conveyor means;

transducer cell means of a sound pick-up type having a feeler tip for generating a sequence of electrical signals when the feeler tip is engaged by the trailing edge of a product;

means mounting said transducer cell means at the second side of said conveyor means in the region of said urging means such that said transducer cell means extends from said second side through said conveyor means and protrudes beyond said first side toward said imbricated product stream with said feeler tip engageable with said product stream; and counter circuit means connected to said transducer cell means and responsive to a first electrical signal of each generated signal sequence for counting the products of said stream.

2. The apparatus as defined in claim 1, wherein:

said transducer cell means comprises at least one runner and a housing;

said runner being attached to said housing and protruding therefrom.

3. The apparatus as defined in claim 2, further including:

means for pivotably mounting said housing for pivotable motion about a pivot axis; and spring means for resiliently pre-biasing said runner against said imbricated product stream.

4. The apparatus as defined in claim 3, wherein:

said runner is dispositioned substantially at right angles to the pivot axis of said housing.

5. The apparatus as defined in claim 4, wherein:

said feeler tip of said transducer cell means extends substantially in the same direction as the runner.

6. The apparatus as defined in claim 4, wherein:

said runner comprises a flexed arm at an end thereof; and said feeler tip having an end which intersects the flexed arm at the end of said runner.

7. The apparatus as defined in claim 1, wherein:

said means mounting said transducer cell means comprises:

a stationarily mounted guide tube;

a sleeve displaceably mounted upon said guide tube and protruding therefrom;

said sleeve having a protruding end equipped with a support surface;

means mounting said transducer cell means in said sleeve with the feeler tip extending through said support surface.

8. The apparatus as defined in claim 7, further including:

spring means for forcing the sleeve away from the guide tube.

9. The apparatus as defined in claim 8, wherein:

said protruding end of said sleeve possesses a rounded portion extending up to the support surface;

said feeler tip comprising a pin;

said support surface having a bore; and said pin extending through said bore of said support surface.

10. A method of counting multisheet folded printed products conveyed in a continuous imbricated product steam in which the folded edge of each product is leading in the conveying direction and overlapping the preceding printed products and the edge opposite the folded edge is trailing comprising the steps of:

conveying the imbricated product stream on a conveyor having a first side and a second side, said imbricated product stream being conveyed on said first side such that the trailing edges of the products opposite the folded edges bear against said first side;

urging the imbricated product stream against the first side of the conveyor at a location along the path of travel of said stream;

sensing, by means of a sound pick-up type transducer cell, the trailing edges of said products, at said urging location;

generating a sequence of electrical signals in response to the sensing of said trailing edges; and counting a first electrical signal of each generated signal sequence.

* * * * *